US005269410A

United States Patent [19]

Abregano

[11] Patent Number: 5,269,410

[45] Date of Patent: Dec. 14, 1993

[54] GOLF ACCESSORY ORGANIZER

[76] Inventor: Jeffery M. Abregano, P.O. Box 5832, Hilo, Hi. 96720

[21] Appl. No.: 952,598

[22] Filed: Sep. 28, 1992

[51] Int. Cl.[5] ..... A63B 57/00

[52] U.S. Cl. ..... 206/315.5; 206/315.3; 224/274; 224/918

[58] Field of Search ..... 206/315.3-315.5, 206/315.2, 315.9; 224/918, 223, 919; 273/32 R, 32 A, 32 B, 32 D

[56] References Cited

U.S. PATENT DOCUMENTS

| | | | |
|---|---|---|---|
| 1,806,797 | 5/1931 | Guiterman | 224/918 X |
| 3,272,412 | 9/1966 | Antonious | 224/918 X |
| 3,320,620 | 5/1967 | Weidler et al. | 224/918 X |
| 3,744,542 | 7/1973 | Stephens et al. | 273/32 A X |
| 3,753,519 | 8/1973 | Gammon | 224/918 X |
| 3,968,522 | 7/1976 | Riess | 224/918 X |
| 4,069,954 | 1/1978 | Rauch | 224/918 X |
| 4,129,237 | 12/1978 | Grinder | 224/918 X |
| 4,804,121 | 2/1989 | Stanton et al. | 206/315.5 X |
| 4,869,365 | 9/1989 | Perdue et al. | 206/315.5 |
| 4,886,196 | 12/1989 | Plummer | 224/918 X |
| 4,893,739 | 1/1990 | Conner | 224/918 X |
| 4,901,899 | 2/1990 | Barrett | 224/223 |
| 4,974,763 | 12/1990 | Widrig | 273/32 B X |
| 5,024,361 | 6/1991 | Flowers | 224/223 |
| 5,031,812 | 7/1991 | Gustine | 206/315.5 X |
| 5,096,059 | 3/1992 | Henderson | 206/315.5 |
| 5,176,253 | 1/1993 | Perrin et al. | 206/315.5 |

*Primary Examiner*—Sue A. Weaver
*Attorney, Agent, or Firm*—Michael I. Kroll

[57] ABSTRACT

A golf accessory organizer is provided, which consists of a portfolio being rectangular shaped. A spring clip is for removably attaching an upper short side of the portfolio to a top cuff of a golf bag. A hook and loop fabric fastener strip is for removably retaining the portfolio in a folded closed position. An elastic band is affixed to an inner surface of the portfolio, for holding in a neatly organized manner, a plurality of tees and a divot fixer with a ball marker thereto. A pouch is affixed to the inner surface of the portfolio below the elastic band for storing a plurality of other small supplies and items thereto. A second hook and loop fabric fastener strip is for sealing the pouch to prevent the other small supplies and items from falling out of the pouch.

7 Claims, 2 Drawing Sheets

GOLF ACCESSORY ORGANIZER

BACKGROUND OF THE INVENTION

1. Field of the Invention

The instant invention relates generally to golf equipment and more specifically it relates to a golf accessory organizer.

2. Description of the Prior Art

Numerous golf equipment have been provided in prior art that are adapted to be utilized by golfers to enhance and improve the golf games of the golfers. While these units may be suitable for the particular purpose to which they address, they would not be as suitable for the purposes of the present invention as heretofore described.

SUMMARY OF THE INVENTION

A primary object of the present invention is to provide a golf accessory organizer that will overcome the shortcomings of the prior art devices.

Another object is to provide a golf accessory organizer that can be removably attached to a top cuff of a golf bag, so that various small items and supplies can be conveniently carried thereon.

An additional object is to provide a golf accessory organizer in which the various small items and supplies can be neatly organized therein to allow quick access thereto.

A further object is to provide a golf accessory organizer that is simple and easy to use.

A still further object is to provide a golf accessory organizer that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
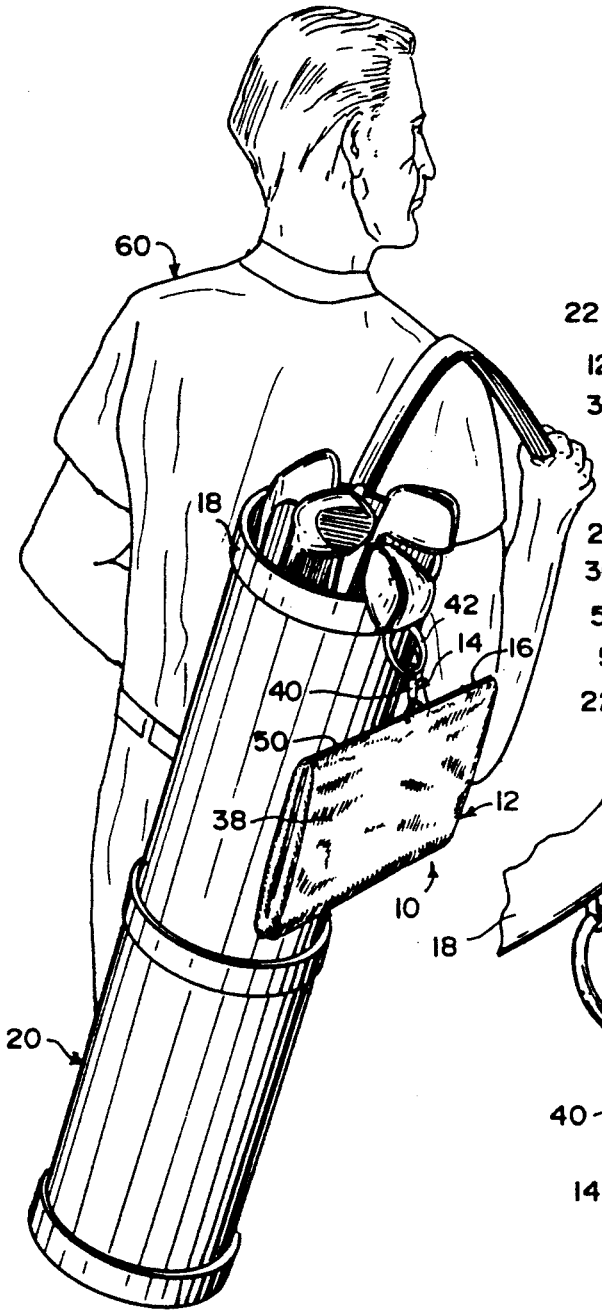
FIG. 1 is a perspective view of the instant invention in its closed position attached to a ring at the top cuff of a golf bag being carried by a golfer.
Figure 2:
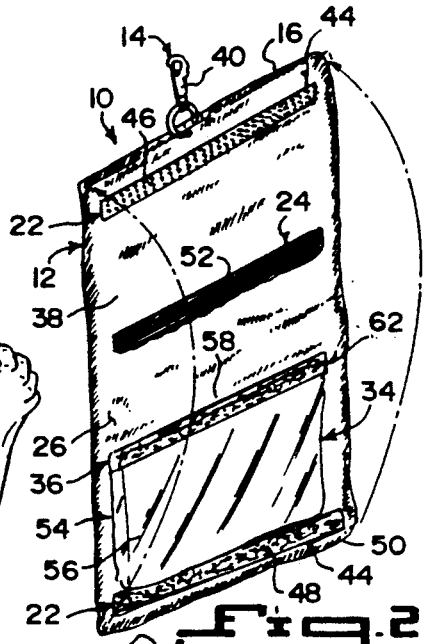
FIG. 2 is a perspective view of the instant invention per se in an opened position.
Figure 3:
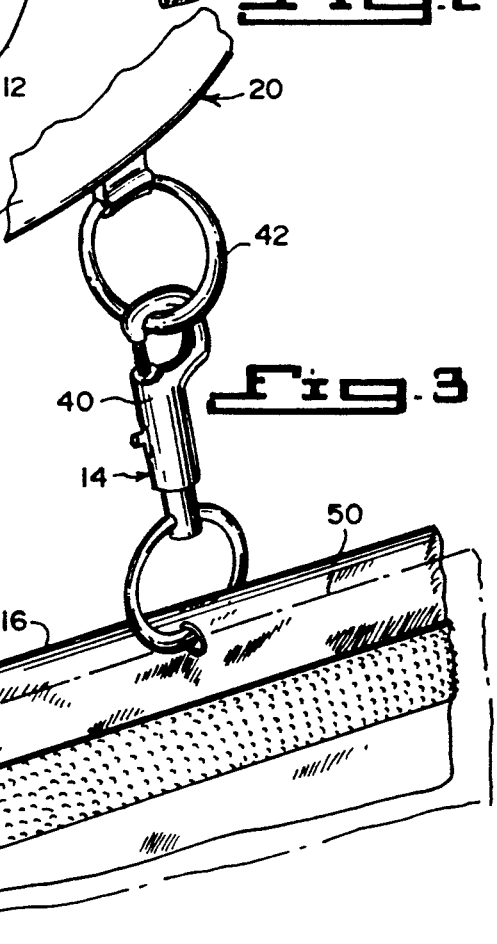
FIG. 3 is an enlarged perspective view of a portion of the instant invention showing the clip in greater detail attached to the ring at the top cuff of the golf bag.
Figure 4:
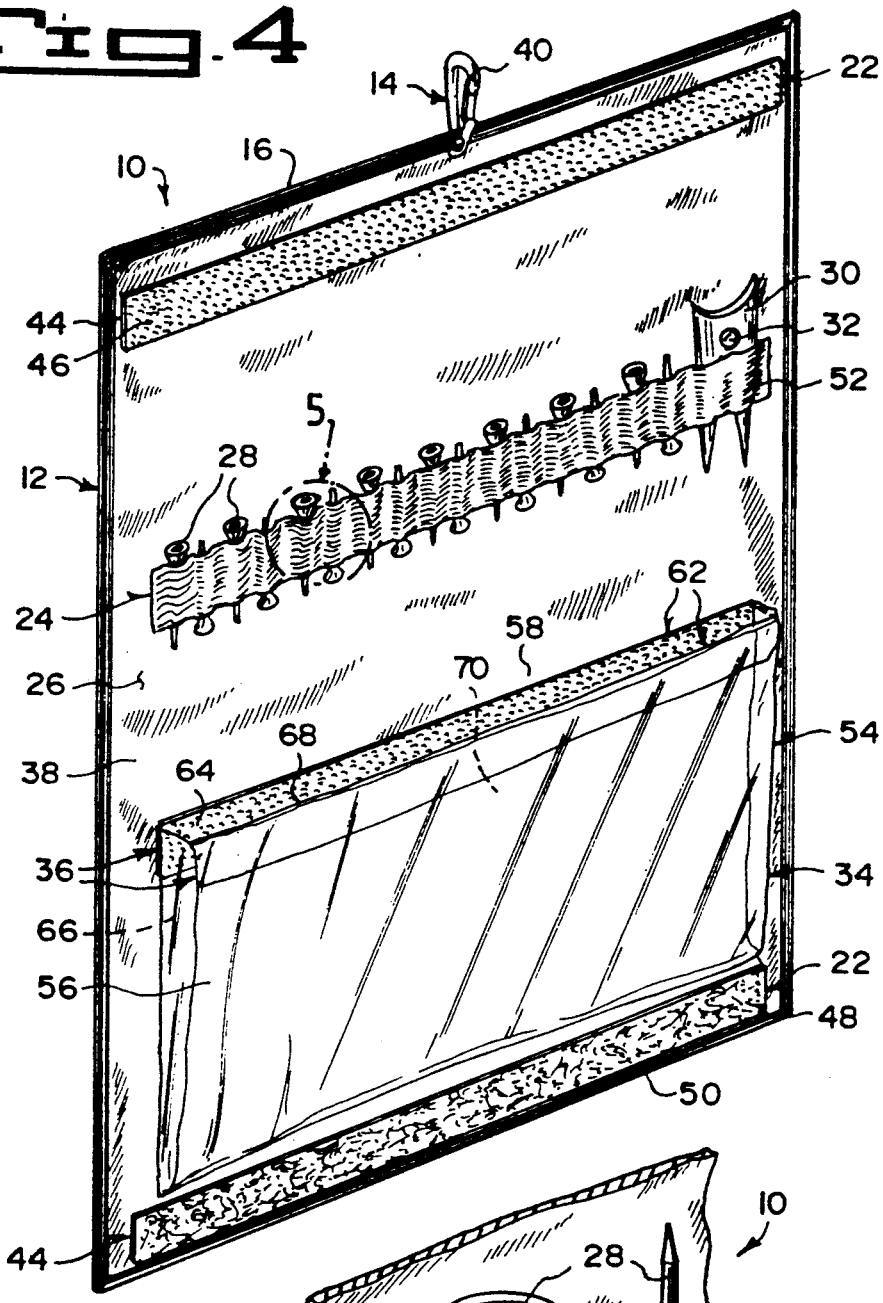
FIG. 4 is a perspective view of the instant invention in its opened position showing tees and a divot fixer with ball marker retained in an elastic band.
Figure 5:
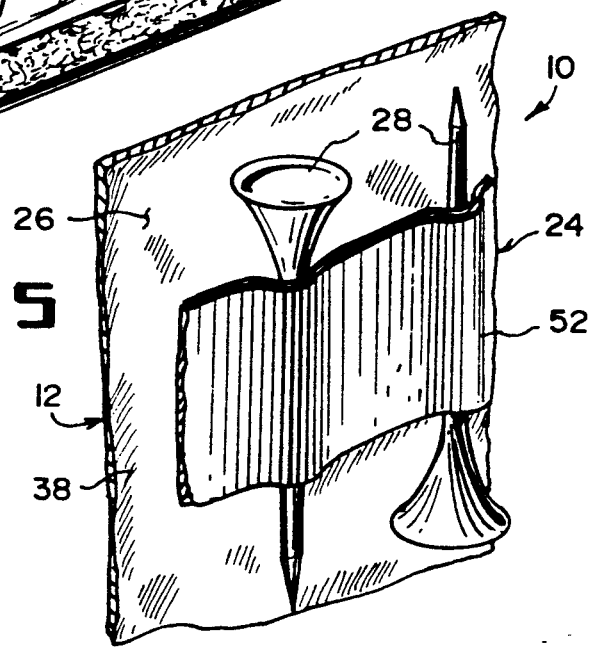
FIG. 5 is an enlarged perspective view as indicated by arrow 5 in FIG. 4 of a portion of the elastic band holding the tees therein.

Turning now descriptively to the drawings, in which similar reference characters denote similar elements throughout the several views, the FIGS. illustrate a golf accessory organizer 10, which consists of a portfolio 12 being rectangular shaped. A device 14 is for removably attaching an upper short side 16 of the portfolio 12 to a top cuff 18 of a golf bag 20. A first fastener 22 is for removably retaining the portfolio 12 in a folded closed position. A structure 24 is affixed to an inner surface 26 of the portfolio 12, for holding in a neatly organized manner, a plurality of tees 28 and a divot fixer 30 with a ball marker 32 thereto.

An apparatus 34 is affixed to the inner surface 26 of the portfolio 12 below the holding structure 24 for storing a plurality of other small supplies and items thereto. A second fastener 36 is for sealing the storing apparatus 34 to prevent the other small supplies and items from falling out of the storing apparatus 34.

The portfolio 12 is fabricated out of a thin flexible lightweight durable sheet 38. The sheet 38 is made of waterproof material, so as to prevent water damage to the contents therein when in a folded closed position.

The removably attaching device 14 is a spring clip 40, so that it can engage with a ring 42 on the top cuff 18 of the golf bag 20. The first fastener 22, is a hook and loop fabric fastener strip 44. A first portion 46 of the strip 44 is attached to the inner surface 26 of the sheet 38 proximate the upper short side 16. A second portion 48 of the strip is attached to the inner surface 26 of the sheet 38 proximate a lower short side 50. When the sheet 38 is placed in its folded closed position, the first portion 46 of the strip 44 will engage with the second portion 48 of the strip 44.

The holding structure 24 is an elastic band 52, secured to the inner surface of the sheet 38 below the first portion 46 of the strip 44. The storing apparatus 34 is a pouch 54, secured to the inner surface 26 of the sheet 38 above the second portion 48 of the strip 44. The pouch 54 is fabricated out of a thin flexible lightweight durable layer 56. The layer 56 is made of waterproof material, so as to prevent water damage to the contents therein, when the pouch 54 is sealed along its open top edge 58. The waterproof material is transparent, so that a person 60 can see the contents within the pouch 54 without having to open the pouch 54.

The second fastener 36 is a second hook and loop fabric fastener strip 62, in which a first portion 64 of the second strip 62 is attached to one inner side 66 of the pouch 54 at the open top edge 58. A second portion 68 of the second strip 62 is attached to an opposite inner side 70 of the pouch 54, at the open top edge 58. When the open top edge 58 is closed, the first portion 64 of the second strip 62 will engage with the second portion 68 of the second strip 62.

The sheet 38 of the portfolio 12 can be made of nylon and is typically, but not limited to the size twelve inches long and six inches wide and will normally fold in half in the middle between its long sides. It can preferably come in four different colors, black with grey trimming, blue, red and white with black trimming, which can match in color with the golf bag 20. The small supplies and items carried in the pouch 54 can be typically, but not limited to gloves, money, gum, lip balm, bandaids, aspirins, a pen, tissues and a pack of cigarettes.

LIST OF REFERENCE NUMBERS

10 golf accessory organizer
12 portfolio
14 removably attaching device
16 upper short side of 12
18 top cuff
20 golf bag
22 first fastener 24 holding structure
26 inner surface of 12
28 tee
30 divot fixer
32 ball marker on 30
34 storing apparatus
36 second fastener
38 thin flexible lightweight durable sheet for 12
40 spring clip for 14
42 ring on 18
44 first hook and loop fabric fastener strip for 22
46 first portion of 44
48 second portion of 44
50 lower short side of 12
52 elastic band for 24
54 pouch for 34
56 thin flexible lightweight durable layer for 54
58 open top edge 58 of 54
60 person
62 second hook and loop fabric fastener strip for 36
64 first portion of 62
66 inner side of 54
68 second portion of 62
70 opposite inner side of 54

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A golf accessory organizer which comprises:

a) a portfolio being rectangular shaped;

b) means for removably attaching an upper short side of said portfolio to a top cuff of a golf bag;

c) means for removably retaining said portfolio in a folded closed position;

d) means affixed to an inner surface of said portfolio, for holding in a neatly organized manner, a plurality of tees and a divot fixer with a ball marker thereto;

e) means affixed to the inner surface of said portfolio below said holding means, for storing a plurality of other small supplies and items thereto; and f) means for sealing said storing means to prevent the other small supplies and items from falling out of said storing means, said portfolio is fabricated out of a thin flexible lightweight durable sheet, said sheet is made of waterproof material, so as to prevent water damage to the contents therein when in a folded closed position, said removably attaching means is a spring clip, so that it can engage with a ring on the top cuff of the golf bag, said removably retaining means is a hook and loop fabric fastener strip, in which a first portion of said strip is attached to the inner surface of said sheet proximate the upper short side, while a second portion of said strip is attached to the inner surface of said sheet proximate a lower short side, so that when said sheet is placed in its folded closed position the first portion of said strip will engage with the second portion of said strip.

2. A golf accessory organizer as recited in claim 1, wherein said holding means is an elastic band secured to the inner surface of said sheet below the first portion of said strip.

3. A golf accessory organizer as recited in claim 2, wherein said storing means is a pouch secured to the inner surface of said sheet above the second portion of said strip.

4. A golf accessory organizer as recited in claim 3, wherein said pouch is fabricated out of a thin flexible lightweight durable layer.

5. A golf accessory organizer as recited in claim 4, wherein said layer is made of waterproof material, so as to prevent water damage to the contents therein when said pouch is sealed along its open top edge.

6. A golf accessory organizer as recited in claim 5, wherein said waterproof material is transparent, so that a person can see the contents within said pouch without having to open said pouch.

7. A golf accessory organizer as recited in claim 6, wherein said sealing means is a second hook and loop fabric fastener strip, in which a first portion of said second strap is attached to one inner side of said pouch at the open top edge, while a second portion of said second strip is attached to an opposite inner side of said pouch at the open top edge, so that when the open top edge is closed the first portion of said second strip will engage with the second portion of said second strip.

* * * * *